US008315547B2

(12) United States Patent
Jung et al.

(10) Patent No.: US 8,315,547 B2
(45) Date of Patent: Nov. 20, 2012

(54) IMAGE FORMING APPARATUS AND CONTROL METHOD THEREOF

(75) Inventors: Won Chul Jung, Suwon-si (KR); Myung Ho Kyung, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 206 days.

(21) Appl. No.: 12/691,022

(22) Filed: Jan. 21, 2010

(65) Prior Publication Data

US 2010/0189456 A1 Jul. 29, 2010

(30) Foreign Application Priority Data

Jan. 23, 2009 (KR) ..... 10-2009-0006144

(51) Int. Cl.
*G03G 15/20* (2006.01)

(52) U.S. Cl. ..... 399/314; 399/66; 399/308

(58) Field of Classification Search ..... 399/45, 399/66, 121, 297, 302, 303, 308, 310, 313, 399/314
See application file for complete search history.

(56) References Cited

U.S. PATENT DOCUMENTS 5,159,392 A * 10/1992 Kasahara et al. ..... 399/309
5,600,405 A * 2/1997 Umeda et al. ..... 399/71
6,226,486 B1 * 5/2001 Itou et al. ..... 399/303

FOREIGN PATENT DOCUMENTS

JP 2001-066911 3/2001

* cited by examiner

*Primary Examiner* — Walter L Lindsay, Jr.
*Assistant Examiner* — Benjamin Schmitt
(74) *Attorney, Agent, or Firm* — Stanzione & Kim, LLP

(57) ABSTRACT

An image forming apparatus and a control method in which a power source having the same polarity as that of a transfer power source can be applied to a drive roller at a time at which an upper end of the recording medium is detached from the ITB, such that repulsive force against the recording medium can occur, and the detachment of the recording medium can be more easily carried out. Another power source having the opposite polarity to the transfer power source can be applied to the drive roller at another time at which the adhesive force between the back end of the recording medium and the ITB becomes weaker, such that attractive force drawing the recording medium to the ITB can occur and the recording medium can be brought into contact with the ITB with higher force.

8 Claims, 7 Drawing Sheets

IMAGE FORMING APPARATUS AND CONTROL METHOD THEREOF

CROSS-REFERENCE TO RELATED APPLICATIONS

This application claims the benefit of Korean Patent Application No. 2009-0006144, filed on Jan. 23, 2009 in the Korean Intellectual Property Office, the disclosure of which is incorporated herein by reference in its entirety.

BACKGROUND

1. Field of the Invention

Embodiments of the present general inventive concept relate to an image forming apparatus to form an image by attaching a recording medium to an image transfer belt (ITB) carrying the recording medium and to easily detach a front end of the recording medium from the image transfer belt (ITB), and a method of controlling such image forming apparatus.

2. Description of the Related Art

Generally, a photo-transfer type image forming apparatus illuminates light on a photo-conductor which is charged with a predetermined potential so as to form an electrostatic latent image. In the image forming apparatus, this electrostatic latent image is developed with a toner used as a developing solution, and the developed image is transferred to the recording medium, such that a color image is formed.

The photo-transfer type image forming apparatus can be classified into an indirect transfer type and a direct transfer type. The indirect transfer type image forming apparatus transfers the image developed on the photo-conductor onto an image transfer belt (ITB), and then the developed image is transferred onto the recording medium. The direct transfer type image forming apparatus directly transfers the image developed on the photo-conductor onto the recording medium transferred by a paper transfer belt (PTB). An image forming apparatus according to an embodiment of the present general inventive concept can be applied to the indirect transfer type and direct transfer type apparatus, such that detachment of a front end of the recording medium may be easily carried out.

For example, the direct transfer type image forming apparatus develops toners of cyan (C), magenta (M), yellow (Y) and black (B) on a photo-conductor on which an electrostatic latent image is formed, and the developed images are sequentially and directly transferred on the recording medium which is moved by a belt carrying the recording medium. The transferred image is fixed by a fixing unit, such that a color image is formed.

In the direct transfer type image forming apparatus, the recording medium is brought into contact with the transfer belt and moves. This recording medium passes respective photo-conductors, such that images overlap with each other on the recording medium, and the recording medium including the overlapped images is transferred. Thereafter, a drive roller makes a detachment angle, such that the recording medium is detached from the image transfer belt (ITB). This recording medium enters the fixing unit, such that the resultant image is fixed onto the recording medium.

In this case, when the recording medium enters the fixing unit after being detached from the image transfer belt (ITB), the recording medium intentionally forms a curl. In this case, if the degree of the formed curl exceeds the intended degree, or if the recording medium is detached from the image transfer belt (ITB) before passing the drive roller after passing the last photo-conductor, a back end of the recording medium may be swept away by a structure positioned between the transfer unit and the fixing unit.

Also, if the recording medium is not detached from the image transfer belt (ITB) at a detachment angle formed by the drive roller when passing the drive roller, or if the recording medium is detached from the image transfer belt (ITB) at another angle behind the detachment angle, the recording medium wrongly enters the fixing unit and collides with peripheral structures of the fixing unit, such that unexpected image distortion arises or the recording medium may be caught in any peripheral structures of the fixing unit without correctly entering the fixing unit. Specifically, if the recording medium is thin and has a high resistance, there are large amounts of charges in the recording medium, and the recording medium is easily bent, such that the recording medium may be wrongly detached from a part where the detachment angle is formed.

The above-mentioned problems may also occur in the direct transfer type apparatus and the indirect transfer type apparatus.

SUMMARY

Example embodiments of the present general inventive concept can provide an image forming apparatus including a drive roller to rotate an image transfer belt (ITB) carrying a recording medium with an appropriate power source, such that a front end of the recording medium can be easily detached from the image transfer belt (ITB), and at the same time can prevent the front end of the recording medium from being detached from the image transfer belt (ITB) before a front end of the recording medium passes the drive roller.

Additional embodiments of the present general inventive concept will be set forth in part in the description which follows and, in part, will be obvious from the description, or may be learned by practice of the general inventive concept.

Embodiments of the present general inventive concept may be achieved by providing an image forming apparatus including an image transfer belt (ITB) to carry a recording medium onto which an image is transferred by a transfer device, a roller unit to support and rotate the image transfer belt (ITB), a power-source unit to provide the roller unit with a power source, and a controller to control the power-source unit to adjust the power source provided to the roller unit, wherein the controller can provide the roller unit with a power source having the same polarity as that of a transfer power source of the transfer device.

Example embodiments of the present general inventive concept may also be achieved by providing an image forming apparatus including an image transfer belt (ITB) to carry a recording medium on which an image is transferred by a transfer device, a roller unit to support and rotate the image transfer belt (ITB), a power-source unit to provide the roller unit with a power source, and a controller to control the power-source unit to adjust the power source provided to the roller unit, wherein the controller performs at least one of providing the roller unit with a power source having the same polarity as that of a transfer power source of the transfer device after a front end of the recording medium reaches the roller unit, and providing the roller unit with a power source having a polarity opposite to that of the transfer power source before a back end of the recording medium reaches the roller unit.

Example embodiments of the present general inventive concept may also be achieved by providing a method of controlling an image forming apparatus which includes an image transfer belt (ITB) to carry a recording medium on which an image is transferred by a transfer device, and a roller unit to support and rotate the image transfer belt (ITB), the method including determining whether the recording medium reaches the roller unit, and providing the roller unit with a power source having the same polarity as that of a transfer power source of the transfer device, when the recording medium reaches the roller unit.

Example embodiments of the present general inventive concept may also be achieved by providing a method of controlling an image forming apparatus which includes an image transfer belt (ITB) to carry a recording medium on which an image is transferred by a transfer device, and a roller unit to rotate the image transfer belt (ITB), the method including determining whether the recording medium reaches the roller unit, determining a type of the recording medium when the recording medium reaches the roller unit, deciding a power-source level corresponding to the type of the recording medium, and providing the roller unit with a power source, which has the same polarity as that of a transfer power source of the transfer device and the decided power-source level.

Example embodiments of the present general inventive concept may also be achieved by providing a transfer unit of an image forming apparatus, including an image transfer belt (ITB) to carry a recording medium through the transfer unit, a power unit to supply power to the image transfer belt to transfer an image from the ITB to the recording medium, and a controller to control the power unit to supply another power to the ITB to detach a front end of the recording medium from the ITB when the front end of the recording medium reaches a predetermined location of the transfer unit.

The controller can control the power unit to supply yet another power to the ITB to attach a back end of the recording medium to the ITB before the back end of the recording medium reaches the predetermined location of the transfer unit.

The transfer unit can include a roller unit to drive the ITB and to receive the another power from the power unit and transfer same to the ITB.

Example embodiments of the present general inventive concept may also be achieved by providing a method of controlling a transfer unit of an image forming apparatus, including carrying a recording medium through the transfer unit with an image transfer belt (ITB), supplying power to the ITB to transfer an image from the ITB to the recording medium, and supplying another power to the ITB to detach a front end of the recording medium from the ITB when the front end of the recording medium reaches a predetermined location of the transfer unit.

The method can further include supplying yet another power to the ITB to attach a back end of the recording medium to the ITB before the back end of the recording medium reaches the predetermined location of the transfer unit.

BRIEF DESCRIPTION OF THE DRAWINGS

These and/or other embodiments of the present general inventive concept will become apparent and more readily appreciated from the following description of the embodiments, taken in conjunction with the accompanying drawings of which.

DETAILED DESCRIPTION OF THE EMBODIMENTS

Figure 1:
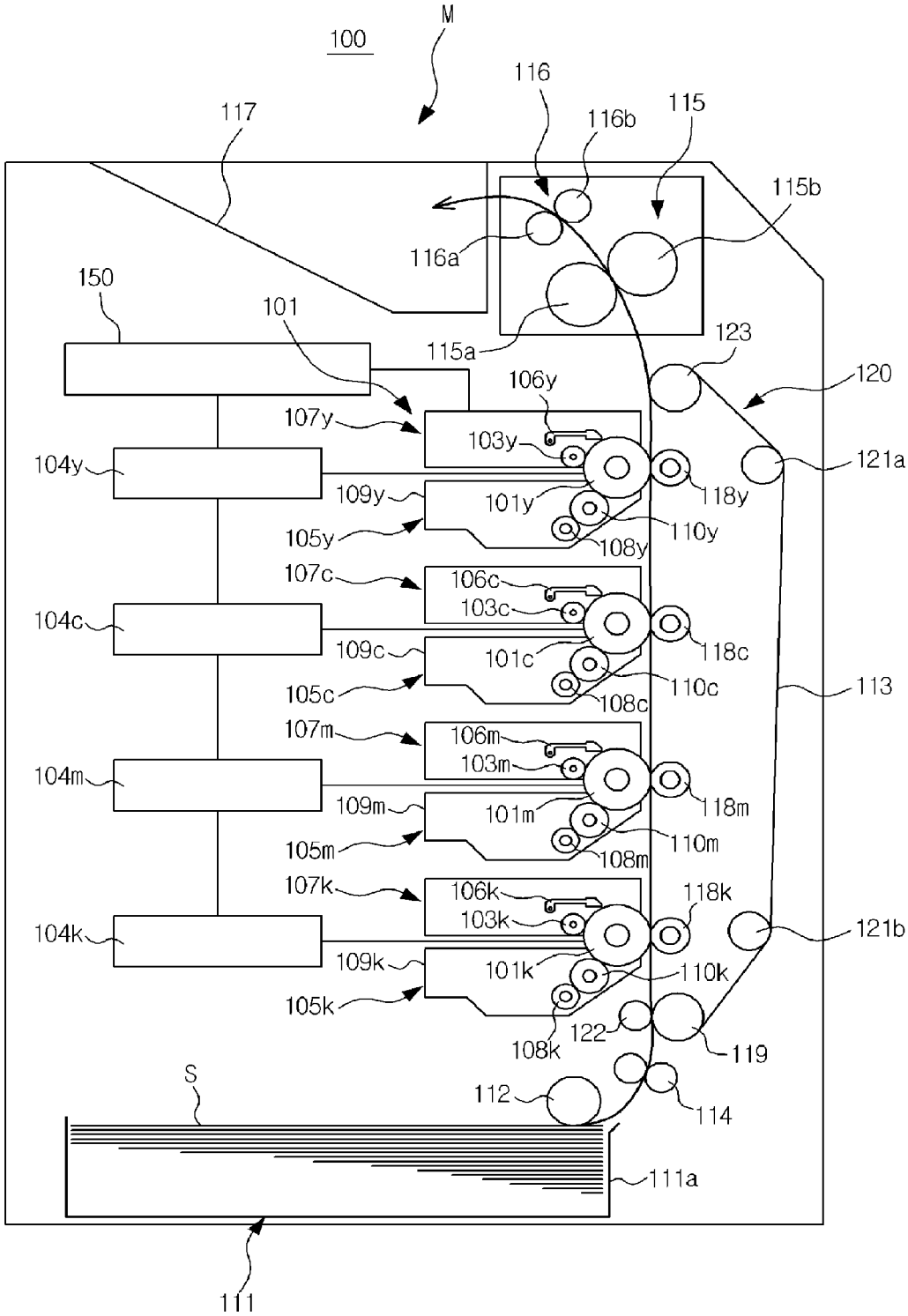
FIG. 1 is a schematic diagram illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a schematic diagram illustrating an image forming apparatus according to an exemplary embodiment of the present general inventive concept. Referring to FIG. 1, the image forming apparatus can include a paper-feeding unit 111, an image forming unit 101, a transfer unit 120, a fixing unit 115, a paper-discharging unit 116, and a controller 150.

The paper-feeding unit 111 can provide a recording medium (S), and can include a paper-feeding cassette, a pickup roller 112, and a registration roller 114. The paper-feeding cassette 111*a* can be mounted to a lower part of a main body M of the apparatus. The recording medium S which is loaded in the paper-feeding cassette 111*a* can be picked up by the pickup roller 112, and can move to the registration roller 114.

The image forming unit 101 can be arranged on the top of the paper-feeding unit 111, and can form an image composed of predetermined colors (black (K), Magenta (M), cyan (C) and yellow (Y)) on the recording medium S.

The image forming unit 101 can include first, second, third, and fourth photo-conductors 101*k*, 101*m*, 101*c*, and 101*y*. The first, second, third, and fourth photo-conductors 101*k*, 101*m*, 101*c*, and 101*y* facing an image transfer belt (ITB) 113 of a transfer unit 120 can be vertically placed apart from a lower part of FIG. 2 by a predetermined distance ranging from the lower part of FIG. 2 to an upper part. Each of the first, second, third, and fourth photo-conductors 101*k*, 101*m*, 101*c*, and 101*y* can be arranged to form a nip region by contacting the image transfer belt (ITB) 113 at a predetermined pressure by each of first, second, third, and fourth transfer devices 118*k*, 118*m*, 118*c*, and 118*y*, and can rotate counterclockwise by a gear train which can receive power from a drive motor.

First, second, third, and fourth chargers 103*k*, 103*m*, 103*c*, and 103*y*, first, second, third, and fourth laser scanning units 104*k*, 104*m*, 104*c*, and 104*y*, and first, second, third, and fourth developing machines 105*k*, 105*m*, 105*c*, and 105*y* can be arranged around the first, second, third, and fourth photo-conductors 101*k*, 101*m*, 101*c*, and 101*y*.

Each of the first, second, third, and fourth chargers 103*k*, 103*m*, 103*c*, and 103*y* can be composed of a charge roller. The first, second, third, and fourth chargers 103*k*, 103*m*, 103*c*, and 103*y* can be brought into contact with the first, second, third, and fourth photo-conductors 101*k*, 101*m*, 101*c*, and 101*y*, respectively. The first, second, third, and fourth chargers

103*k*, 103*m*, 103*c*, and 103*y* can receive a predetermined charging bias power source from a power-source unit upon receiving a control signal from the controller 150. A predetermined charging potential can be applied to the first, second, third, and fourth photo-conductors 101*k*, 101*m*, 101*c*, and 101*y*. For example, if a developing agent has a negative (−) polarity, a charging potential of about −600V can be formed on the first to fourth photo-conductors 101*k*, 101*m*, 101*c*, and 101*y*.

First, second, third, and fourth laser scanners 104*k*, 104*m*, 104*c*, and 104*y* can illuminate laser beams onto first, second, third, and fourth photo-conductors 101*k*, 101*m*, 101*c*, and 101*y* which can be charged by first, second, third, and fourth chargers 103*k*, 103*m*, 103*c*, and 103*y* upon receiving an image signal from a computer or a scanner and the like. As a result, the first to fourth laser scanners 104*k*, 104*m*, 104*c*, and 104*y* can form an electrostatic latent image having a predetermined potential (e.g., a low potential of about −50V) lower than a charging potential. The first, second, third, and fourth laser scanners 104*k*, 104*m*, 104*c*, and 104*y* can have the same construction as in the conventional art, and as such at a detailed description thereof will be omitted herein for convenience of description.

The first, second, third, and fourth developing machines 105*k*, 105*m*, 105*c*, and 105*y* can fix a developing agent for corresponding colors on the first, second, third, and fourth photo-conductors 101*k*, 101*m*, 101*c*, and 101*y* on which the electrostatic latent image is formed, such that they form a visible developing-material image. The first, second, third, and fourth developing machines 105*k*, 105*m*, 105*c*, and 105*y* can include first, second, third, and fourth developing-agent containers 109*k*, 109*m*, 109*c*, and 109*y*, first, second, second, third, and fourth developing rollers 110*k*, 110*m*, 110*c*, and 110*y*, and first, second, third, and fourth developing-agent providing rollers 108*k*, 108*m*, 108*c*, and 108*y*, respectively.

The first, second, third, and fourth developing-agent containers 109*k*, 109*m*, 109*c*, and 109*y* can include a negative-polarity black (K) developing-agent, a negative-polarity yellow (Y) developing-agent, negative-polarity (M) developing-agent, and a negative-polarity cyan (C) developing-agent, respectively.

The first, second, third, and fourth developing rollers 110*k*, 110*m*, 110*c*, and 110*y* and the first, second, third, and fourth photo-conductors 101*k*, 101*m*, 101*c*, and 101*y* can be engaged and rotated together, and can fix the developing agent on respective electrostatic latent images of the first, second, third, and fourth photo-conductors 101*k*, 101*m*, 101*c*, and 101*y*, such that they form an image. The first, second, third, and fourth developing rollers 110*k*, 110*m*, 110*c*, and 110*y* can be arranged close to the surfaces of the first, second, third, and fourth photo-conductors 101*k*, 101*m*, 101*c*, and 101*y*, and can rotate clockwise by a power transmission gear connected to the gear train driving the photo-conductors 101*k*, 101*m*, 101*c*, and 101*y*. Upon receiving a control signal from the controller 150, the first, second, third, and fourth developing rollers 110*k*, 110*m*, 110*c*, and 110*y* can receive a predetermined developing bias power source which can be lower than those of the first to fourth developing-agent providing rollers 108*k*, 108*m*, 108*c*, and 108*y* by 100V~400V, for example, a power source of about −250V.

The first, second, third, and fourth developing-agent providing rollers 108*k*, 108*m*, 108*c*, and 108*y* can transmit the developing agent to the first, second, third, and fourth developing rollers 110*k*, 110*m*, 110*c*, and 110*y* using a potential difference among the first, second, third, and fourth developing rollers 110*k*, 110*m*, 110*c*, and 110*y*. The first, second, third, and fourth developing-agent providing rollers 108*k*, 108*m*, 108*c*, and 108*y* can be brought into contact with one-side lower parts of the first, second, third, and fourth developing rollers 110*k*, 110*m*, 110*c*, and 110*y*, respectively, such that they are arranged to form a nip region. The K developing-agent, the Y developing-agent, the M developing-agent, and the C developing-agent contained in the first, second, third, and fourth developing-agent containers 109*k*, 109*m*, 109*c*, and 109*y* can be transferred to a lower part between each developing-agent providing roller 108*k*, 108*m*, 108*c* or 108*y* and each developing roller 110*k*, 110*m*, 108*c* or 110*y* using an agitator.

Upon receiving a control signal from the controller 150, the first to fourth developing-agent providing rollers 108*k*, 108*m*, 108*c*, and 108*y* can receive a predetermined developing bias power source which can be higher than those of the first to fourth developing-agent providing rollers 110*k*, 110*m*, 110*c*, and 110*y* by 100V~400V, for example, a power source of about −500V. Therefore, the developing agent transferred to the lower part between each developing-agent providing rollers 108*k*, 108*m*, 108*c*, or 108*y* and each developing roller 110*k*, 110*m*, 110*c*, or 110*y* can receive electric charges from the first, second, third, or fourth developing-agent providing roller 108*k*, 108*m*, 108*c*, or 108*y*, such that the developing agent is charged with electricity. In addition, the developing agent can be fixed on the first, second, third, and fourth developing rollers 110*k*, 110*m*, 110*c*, and 110*y*, such that the developing agent is transferred to a nip region between each developing-agent providing rollers 108*k*, 108*m*, 108*c*, or 108*y* and each developing roller 110*k*, 110*m*, 110*c*, or 110*y*.

After the first, second, third, and fourth photo-conductors 101*k*, 101*m*, 101*c*, and 101*y* rotate by one cycle, the first, second, third, and fourth cleaners 107*k*, 107*m*, 107*c*, and 107*y* can remove waste developing agent which may remain on the surfaces of the first, second, third, and fourth photo-conductors 101*k*, 101*m*, 101*c*, and 101*y*. The first, second, third, and fourth cleaners 107*k*, 107*m*, 107*c*, and 107*y* can include first, second, third, and fourth photo-conductor cleaning blades 106*k*, 106*m*, 106*c*, and 106*y*, respectively.

The transfer unit 120 can transfer or copy a developing-agent image formed on the first to fourth photo-conductors 101*k*~101*y* to the recording medium S. The transfer unit 120 can include the image transfer belt (ITB) 113 and first to fourth transfer devices 118*k*, 118*m*, 118*c*, and 118*y*.

The image transfer belt (ITB) 113 can be used to carry the recording medium S. A press unit 122 to press the image transfer belt (ITB) 113 against a passive roller 119 can be arranged to an uppermost part of a recording-medium carrying direction of the image transfer belt (ITB) 113. A predetermined bias power source can be applied to the press unit 122 to press the image transfer belt (ITB) 113 against the passive roller to absorb the image on the image transfer belt (ITB) 113, and the recording medium S can be moved to the image transfer belt (ITB) 113 by the registration roller 114. The press unit 122 can receive a power source having the same polarity as that of the transfer device. If the press unit 122 receives a power source having another polarity, an unexpected problem can occur in transfer efficiency due to the influence of a neighboring transfer device.

Figure 2:
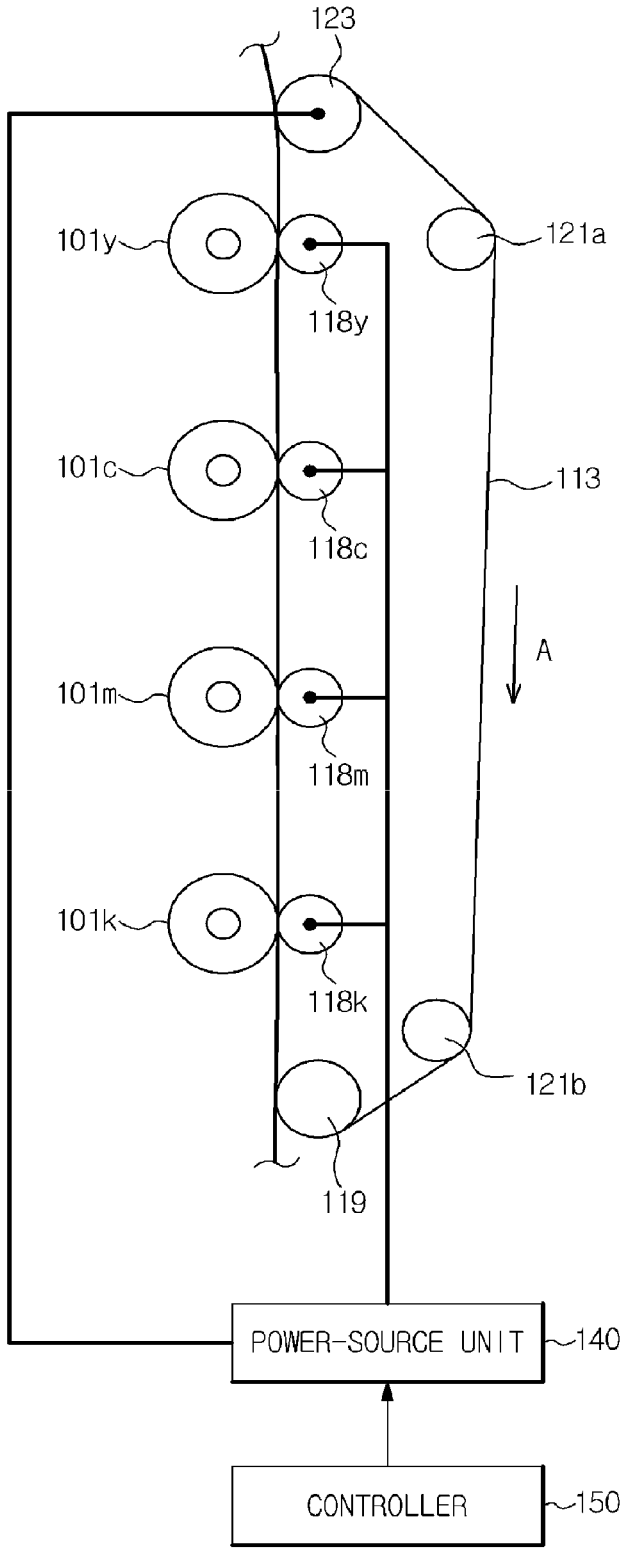
FIG. 2 is a control block diagram illustrating an image forming apparatus according to an exemplary embodiment of the present general inventive concept.

Referring to FIG. 2, the image transfer belt (ITB) 113 can rotate in the "A" direction, i.e., the carrying direction in which the recording medium is carried by several rotating rollers, such as a drive roller 123, first and second tension rollers 121*a* and 121*b*, and a passive roller 119, from a lower part of the recording-medium carrying direction "A" to a higher part.

An organic photoconductive layer can be coated on the image transfer belt (ITB) 113 such that the developing-agent image formed on the first, second, third, and fourth photo-conductors 101*k*, 101*m*, 101*c*, and 101*y* can be transferred or copied.

Each of the first, second, third, and fourth transfer devices 118*k*, 118*m*, 118*c*, and 118*y* can be used as a transfer power-source providing member to provide the image transfer belt (ITB) 113 with a predetermined transfer bias power source. The first, second, third, and fourth transfer devices 118*k*, 118*m*, 118*c*, and 118*y* located inside the image transfer belt (ITB) 113 can press the image transfer belt (ITB) 113 contacting the first, second, third, and fourth photo-conductors 101*k*, 101*m*, 101*c*, and 101*y* with a predetermined pressure. The first, second, third, and fourth transfer devices 118*k*, 118*m*, 118*c*, and 118*y* can receive a predetermined transfer bias power source from a power-source unit controlled by the controller 150.

The fixing unit 115 can be used to fix a developing-agent image copied on the recording medium S, and can include a heating roller 115*a* and a pressing roller 115*b*. The heating roller 115*a* can include a heater to fix the developing-agent image on the recording medium S with a high temperature.

The heating roller 115*b* can be arranged to press the heating roller 115*a* by an elastic-pressurizing member, such that it presses the recording medium (S).

The paper-discharging unit 116 can discharge the recording medium S on which the developing-agent image is fixed toward the discharge tray 117, and can include a paper-discharging roller 116*a* and a backup roller 116*b*.

In the example image forming apparatus based on the direct transfer scheme, the recording medium can move while being brought into contact with the image transfer belt (ITB) 113, and can pass the photo-conductors 101*k*, 101*m*, 101*c*, and 101*y*, such that the overlapping of images can occur and the overlapped result can be transferred. Thereafter, the drive roller 123 can form a detachment angle and can detach the recording medium from the image transfer belt (ITB) 113. Then, the recording medium can enter the fixing unit 115 such that an image can be fixed on the recording medium.

As described above, when the recording medium is detached from the image transfer belt (ITB) 113 and enters the fixing unit 115, the recording medium can intentionally form a curl. In this case, if the degree of the formed curl exceeds the intended degree, or if the recording medium is detached from the image transfer belt (ITB) 113 before passing the drive roller 123 after passing the last photo-conductor 101*y*, a back end of the recording medium may be swept away by a structure positioned between the transfer unit 120 and the fixing unit 115. Also, if the recording medium is not detached from the image transfer belt (ITB) 113 at a detachment angle formed by the drive roller 123 when passing the drive roller 123, or if the recording medium is detached from the image transfer belt (ITB) 113 at another angle behind the detachment angle, the recording medium may wrongly enter the fixing unit 115 and may collide with peripheral structures of the fixing unit 115, such that unexpected image distortion can arise or the recording medium may be caught in any one of peripheral structures of the fixing unit 115 without correctly entering the fixing unit 115. Specifically, if the recording medium is thin and has a high resistance, there can be large amounts of charges in the recording medium, and the recording medium can be easily bent, such that the recording medium may be wrongly detached from a part where the detachment angle is formed.

Therefore, the image forming apparatus according to an exemplary embodiment of the present general inventive concept can provide the drive roller 123 with a power source, such that the drive roller 123 may obviate many problems encountered between the recording medium and the detachment angle, for example, when the recording medium is not detached at the detachment angle or is detached at another angle before the detachment angle.

Figure 3:
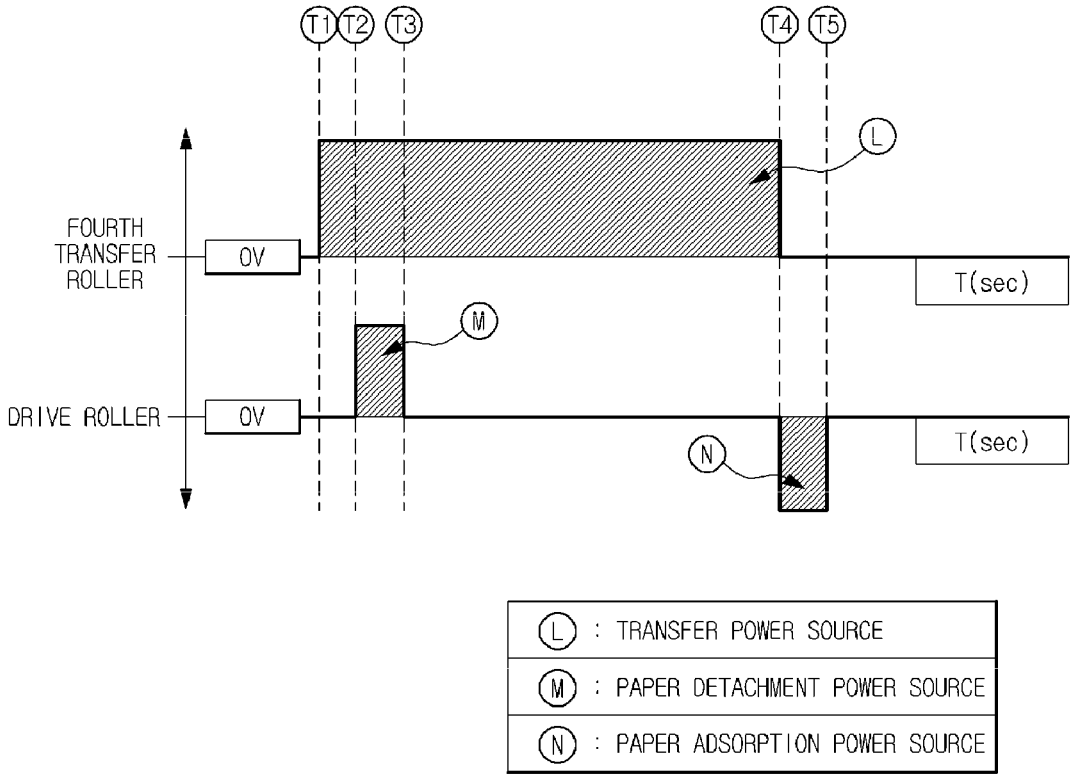
FIG. 3 is a conceptual diagram illustrating a method of detaching and attaching a recording medium from and to an image forming apparatus according to an exemplary embodiment of the present general inventive concept.

For example, referring to FIGS. 2 and 3, a power-source unit 140 of the image forming apparatus can transmit an appropriate power source to the drive roller 123 and each of the first to fourth transfer devices 118*k*, 118*m*, 118*c* and 118*y*. The controller 150 can provide the drive roller 123 with a power source having the same polarity as that of the transfer power source when the front end of the recording medium reaches the drive roller 123, such that the front end of the recording medium can be detached from the image transfer belt (ITB) 113 by repulsive force. In other words, the recording medium transferred to the initial image transfer belt (ITB) can receive a power source having the same polarity as that of the transfer power source, such that it closely contacts the image transfer belt (ITB). Toners of individual colors can be transferred onto the recording medium via a plurality of transfer intervals. If the recording medium on which the image has been formed reaches the front end in the vicinity of the drive roller 123, it can receive a power source having the same polarity as that of the transfer power source, such that the detachment of the front end occurs.

In this case, the controller 150 can decide a type of the recording medium, and can provide the recording medium with a higher or lower power source as compared to a normal power source according to the decided type of the recording medium. For example, the controller 150 can provide a high-resistance recording medium with a power source having a high absolute value, which can be higher than that of a general-resistance recording medium. The controller 150 can provide a low-resistance recording medium with a power source having a low absolute value, which can be lower than that of a general-resistance recording medium. The recording-medium types can be classified according to category, size, thickness, material or resistance of the recording medium. For example, a thick recording medium, a cotton paper, an overhead projector (OHP) film, or a reproduction recording medium or the like can be determined to be a high-resistance recording medium. A user may enter the above recording-medium type using a printing option, or the recording-medium type may be directly detected by a sensor.

After the transfer unit 12 finishes the transfer process, the controller 150 can provide the drive roller 123 with a power source having a polarity opposite to that of the transfer power source, such that the back end of the recording medium closely contacts the image transfer belt (ITB) 113 by attractive force. The controller 150 can decide the type of the recording medium, such that it can provide a higher or lower power source as compared to the normal power source according to the decided type of the recording medium. For example, the controller 150 can provide a high-resistance recording medium with a power source lower than that of a general-resistance recording medium, or can provide a low-resistance recording medium with another power source higher than that of the general-resistance recording medium.

In more detail, when the recording medium passes the drive roller 123, if the recording medium is not detached at a detachment angle formed by the drive roller 123 or is detached at another angle behind the detachment angle, the recording medium may wrongly enter the fixing unit 115 and may collide with peripheral structures of the fixing unit 115, such that unexpected image distortion may arise or the recording medium may be caught in any one of peripheral structures of the fixing unit 115 without correctly entering the fixing unit 115.

In order to prevent the above-mentioned situations from being generated, the controller 150 can provide the drive roller 123 with a power source having the same polarity as that of the transfer power source when the upper end of the recording medium is detached from the image transfer belt (ITB) 113, such that the recording medium may be more easily detached from the image transfer belt (ITB) 113 using repulsive force having the same polarity as that of a charging power source.

In this case, a power source (e.g., signal of 100V~4000V) having the same polarity as that of the transfer power source can be transmitted as a power source used for the detachment of the recording medium to the drive roller 123. For example, if the positive (+) power source is used as the transfer power source, the same positive (+) power source can also be applied to the drive roller 123. If another power source of 100V or lower is used as the transfer power source, this power source may have a weak repulsive force pushing out the recording medium, such that there is no detachment effect. If the above-mentioned power source is 4000V or higher, the image may be unexpectedly distorted or scattered.

Before the recording medium passes the drive roller 123 after passing the last photo-conductor 101*y*, the recording medium can be detached from the image transfer belt (ITB) 113, such that the back end of the recording medium may be swept away by a structure positioned between the transfer unit 120 and the fixing unit 115. In order to prevent this unfavorable situation, a power source having a polarity opposite to the above transfer power source can be provided to the drive roller 123. For example, if the positive (+) power source is used as the transfer power source, the negative (−) power source can be provided to the drive roller 123.

In more detail, because the recording medium is charged with the same power source as the transfer power source while passing the transfer devices 118*k*, 118*m*, 118*c*, and 118*y*, the power source having a polarity opposite to the transfer power source can be provided to the drive roller 123*m*, such that the recording medium may closely contact the image transfer belt (ITB) 113 with a stronger force.

In order to maintain the close contact status between the recording medium and the image transfer belt (ITB) 113, the controller 150 can provide the driver roller 123 with a power source (e.g., signal of −100V~−4000V) having a polarity opposite to the transfer power source. If the power source of less than −100V is provided to the drive roller 123, an attractive force catching the recording medium is very weak, such that the recording medium may be unexpectedly detached from the image transfer belt (ITB) 113. If the power source of more than −4000V is provided to the drive roller 123, the image may be distorted or broken.

For example, provided that the power source of 100V~400V is transmitted as a transfer power source to the first to fourth transfer devices 118*k*~118*y*, and an image is formed on the recording medium, the recording medium passing the transfer devices 118*k*~118*y* via the image transfer belt (ITB) 113 reaches the drive roller 123. In this case, the transfer device 118*y* can be the last transfer device through which the same recording medium passes.

In FIG. 3, a reference symbol 't1' represents a specific time at which the recording medium enters the transfer device 118*y*, and the transfer power source can be received at this time 't1'. Thereafter, the recording medium can move while riding in the image transfer belt (ITB) 113, and can reach the drive roller 123 at a time 't2'. In order to detach the recording medium from the drive roller 123, a power source having the same polarity as that of the transfer power source, for example, the power source of 100V~4000V, can be applied to the drive roller 123. At another time 't3' at which a part of the recording medium which is spaced apart from the front end of the recording medium by about 20 mm passes the drive roller 123, the drive roller 123 can be powered off, such that a status of 0V, i.e., a ground (GND) status, is maintained.

In this case, in association with a time at which the positive (+) power source is received, if the positive (+) power source can be applied to a non-image region located on the recording medium, the image distortion caused by this power source may be minimized. Therefore, a region spaced apart from the front end by about 20 mm is not represented by an absolute value, and the most effective method is for the positive (+) power source for detachment to be applied to a length interval prior to the image interval, which can be transferred on the recording medium by both the photo-conductor and the transfer device. The scope of the present general inventive concept may be accomplished although some image regions overlap with each other to increase the detachment performance, but it is recommended that no overlapping of image regions occurs to help stabilize the image quality.

If the recording medium is thin, it can be difficult for the recording medium to be detached from the belt because the recording medium has weak stiffness, such that a first power source higher than the normal power source of a general recording medium may be used. Otherwise, if the recording medium is thick, it can be easily detached from the belt at a detachment angle due to the recording-medium stiffness, such that a second power source lower than the normal power source may be used. Needless to say, it is possible that the uses of the above two power sources may be reversed according to recording-medium types. In detail, the first power source may be used for the thick recording medium and the second power source may be used for the thin recording medium.

Thereafter, in order to prevent the recording medium from being detached from the image transfer belt (ITB) 113 at a time 't4', a power source (i.e., a power source of −100V~−4000V) having a polarity opposite to the transfer power source can be applied to the drive roller 123, such that the recording medium is not detached from the image transfer belt (ITB) 113 at the time 't4'. In this case, at the time 't4', the back end of the recording medium can be detached from the photo-conductor 101*y* and the transfer device 118*y*. Then, at a time 't5' at which the back end of the recording medium power is detached from the drive roller 123, the drive roller 123 can be powered off.

However, if the drive roller 123 is powered on from a time at which the back end of the recording medium passes the last photo-conductor 101*y* and the transfer device 118*y*, and the image distortion becomes serious, no problems may occur even when the power source is applied to only the non-image region of the back end of the recording medium. In this case, in case of a thick recording medium, since the thick recording medium may be easily detached from the image transfer belt (ITB) 113, the detachment of the recording medium can be prevented by a high power source higher than the normal power source. In case of a thin recording medium, a low power source lower than the normal power source can be used.

In this way, as a reference to judge the recording medium to change a power source applied to the drive roller 123 according to the recording medium type, this power source may be decided by the recording-medium selection button contained in a driver or operation panel of the image forming apparatus, or may be decided according to methods of discriminating the recording medium types during the transfer or copy operation.

Figure 4:
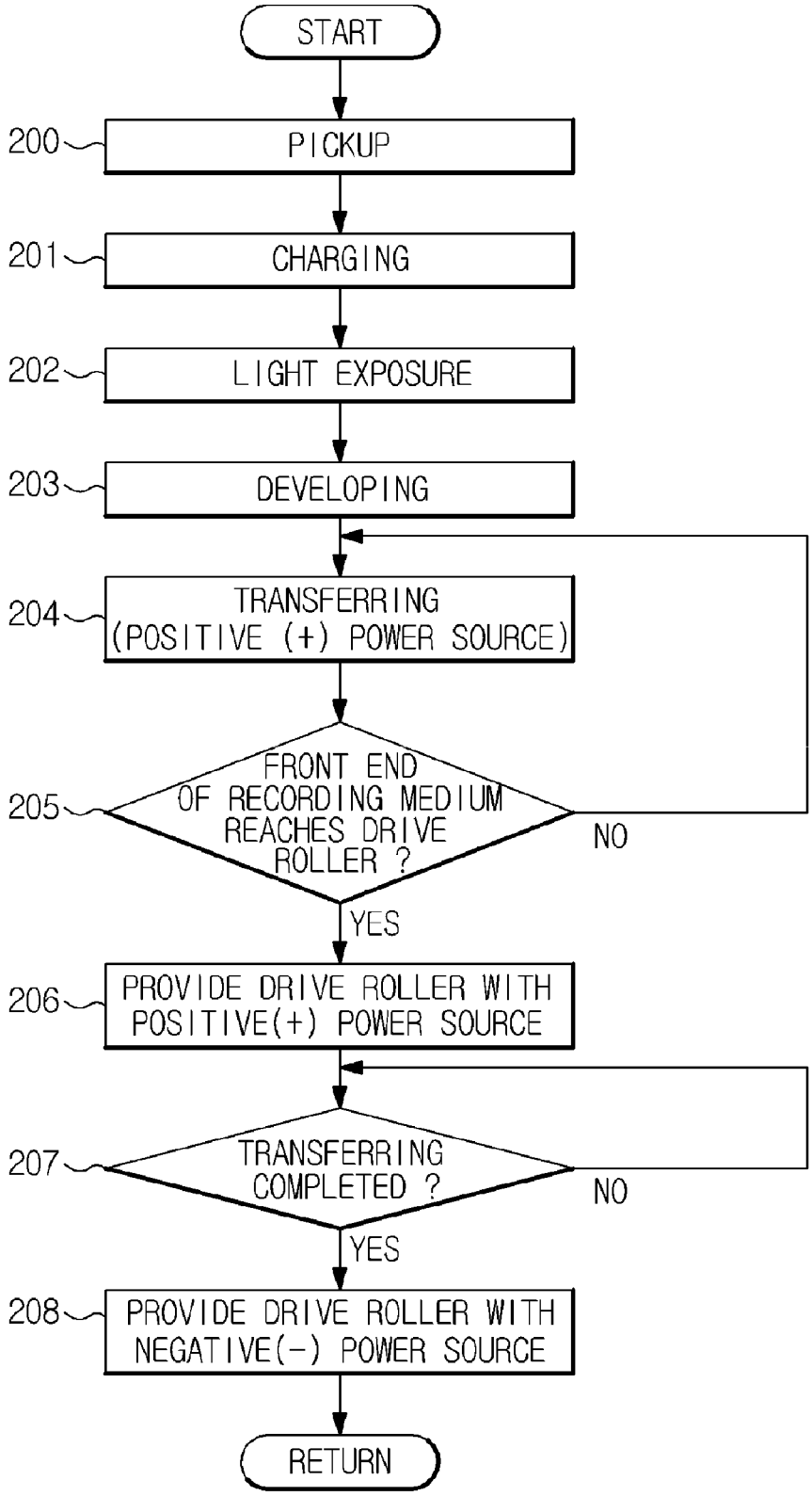
FIG. 4 is a flow chart illustrating a method of controlling an image forming apparatus according to an exemplary embodiment of the present general inventive concept.

FIG. 4 is a flow chart illustrating a method of controlling an image forming apparatus according to an exemplary embodiment of the present general inventive concept. Referring to FIG. 4, the image forming apparatus picks up the recording medium using the paper-feeding unit 111, at operation 200. The negative (−) power source can be applied to the chargers 103*k*, 103*m*, 103*c*, and 103*y*, such that the photo-conductors 101*k*, 101*m*, 101*c*, and 101*y* can be charged with electricity at operation 201. In this case, the picked-up recording medium can move along the moving path of the recording medium by the image transfer belt (ITB) 113 driven by the drive roller 123.

After the photo-conductors 101*k*, 101*m*, 101*c*, and 101*y* are charged with electricity, in order to form an electrostatic latent image on the photo-conductors 101*k*, 101*m*, 101*c*, and 101*y*, the light can be illuminated on the charged photo-conductors 101*k*, 101*m*, 101*c*, and 101*y* via the laser scanners 104*k*, 104*m*, 104*c*, and 104*y*, such that light exposure is performed at operation 202.

After the light exposure is performed, a developing power source having a negative (−) polarity can be applied to the developing rollers 110*k*, 110*m*, 110*c*, and 110*y*, and a developing solution charged with the negative (−) signal can be applied on the photo-conductors 101*k*, 101*m*, 101*c*, and 101*y*, such that the image is developed at operation 203.

After developing the image, a positive (+) power source having an opposite polarity to the developing solution can be applied to the transfer devices 118*k*, 118*m*, 118*c*, and 118*y*, and a developing solution charged with the negative (−) signal on the photo-conductors 101*k*, 101*m*, 101*c*, and 101*y* can be transferred onto the recording medium at operation 204. By the above-mentioned operations, it is possible that in the recording medium carried by the image transfer belt (ITB) 113, the developing solutions for C, M, Y and K can be developed on the photo-conductors 101*k*, 101*m*, 101*c*, and 101*y* on which the electrostatic latent image is formed, and can be sequentially and directly transferred onto the recording medium to overlap the developed images.

At operation 205, it can be determined whether the front end of the recording medium reaches the drive roller 123 during the transfer or copy process. If the front end of the recording medium reaches the drive roller 123, the positive (+) power source can be applied to the drive roller 123, such that the recording medium is easily detached from the image transfer belt (ITB) 113 by repulsive force against the image transfer belt (ITB) 113 while the front end of the recording medium passes the drive roller 123. After the front end of the recording medium is spaced apart from the drive roller 123 by a predetermined distance, the drive roller 123 can be powered off. The front end detached from the image transfer belt (ITB) 113 by the above method can enter the fixing unit 115 and can be seated therein, and then can be discharged from the paper-discharging unit 116.

The image forming apparatus can determine whether the transfer process has been completed at operation 207. If the transfer process is completed in the photo-conductor 101*y* and the transfer device 118*y* of the last image forming unit, the negative (−) power source can be applied to the drive roller 123 before the back end of the recording medium reaches the drive roller 123, such that the back end of the recording medium which escapes from the transfer device 118*y* is not detached from the image transfer belt (ITB) by attractive force for the image transfer belt (ITB) 113. Therefore, when the back end of the recording medium is detached from the drive roller 123, the drive roller 123 can be powered off.

The above-mentioned image forming apparatus can provide the drive roller with the same or opposite-polarity power source as the transfer power source irrespective of the recording medium type, such that the front end of the recording medium can be detached from the image transfer belt (ITB) and the back end thereof may not be detached from the image transfer belt (ITB) 113. If different power sources classified according to the recording-medium types are applied to the drive roller 123, the detachment or attachment of the recording medium can be more effectively carried out.

Figure 5A:
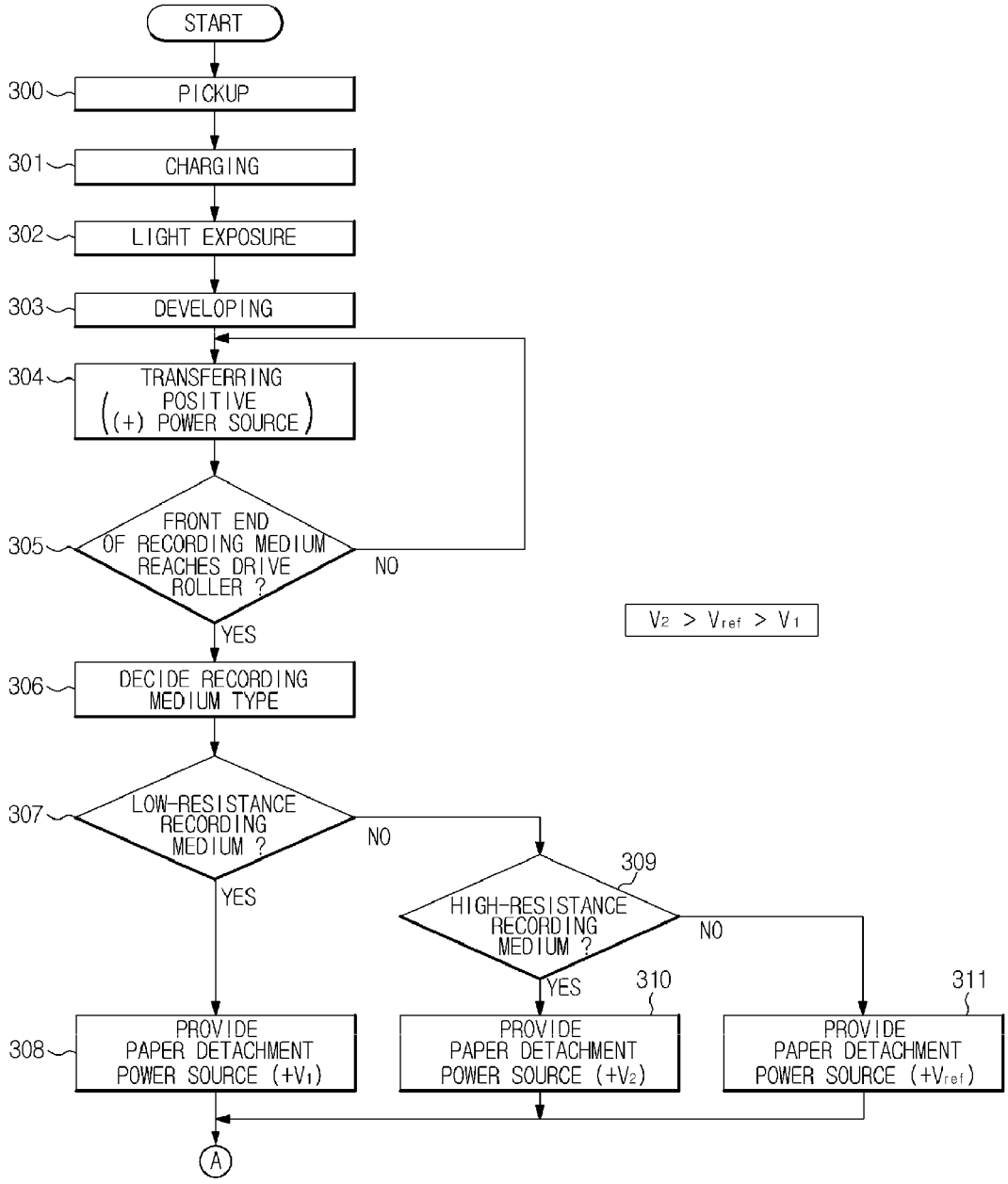
FIGS. 5A and 5B are flow charts illustrating a method of controlling an image forming apparatus according to another exemplary embodiment of the present general inventive concept.
Figure 5B:
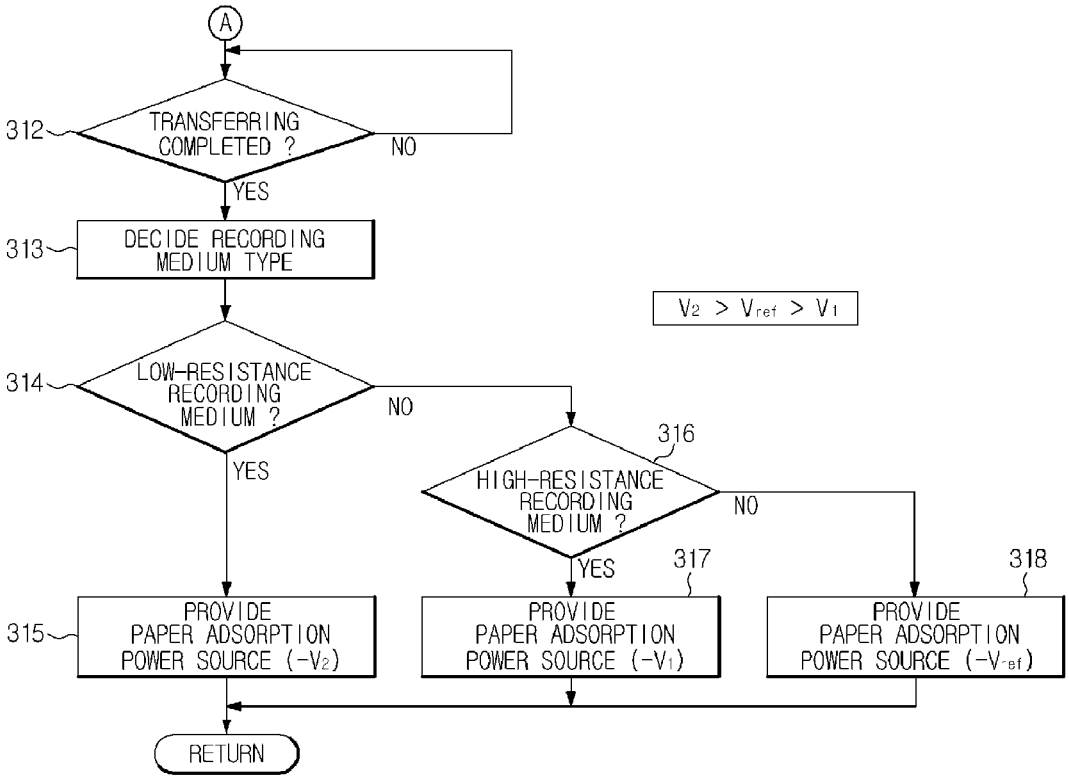
Figure 6:
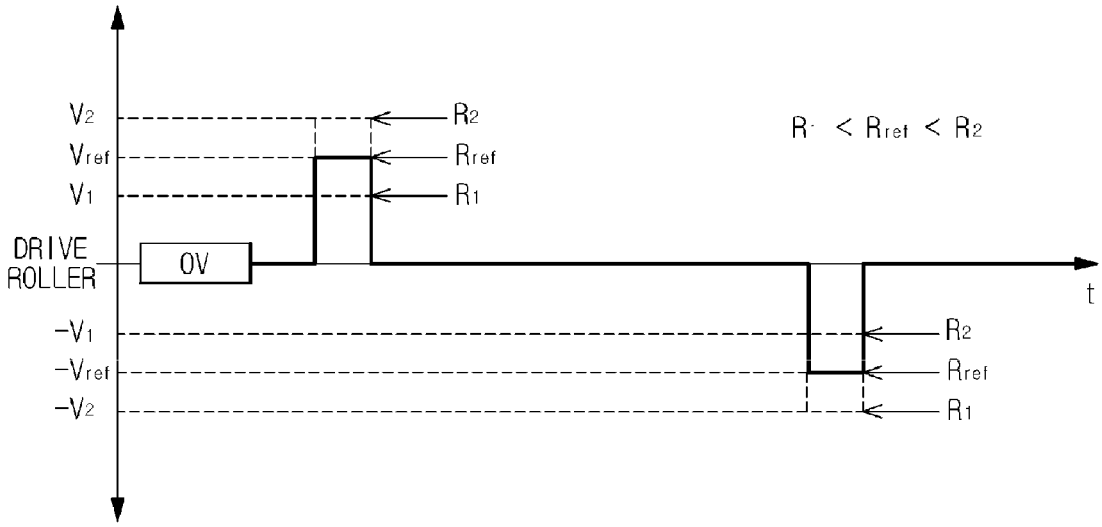
FIG. 6 is a conceptual diagram illustrating a method of providing a drive roller with different power sources classified according to types of a recording medium.

FIGS. 5A and 5B are flow charts illustrating a method of controlling an image forming apparatus according to another exemplary embodiment of the present general inventive concept. FIG. 6 is a conceptual diagram illustrating a method of providing the drive roller with different power sources classified according to recording medium types.

Referring to FIGS. 5A, 5B, and 6, in the recording medium which is carried by the image transfer belt (ITB) 113 through the pickup, charging, developing and transferring processes, developing solutions for C, M, Y and K can be developed on the photo-conductors 101*k*, 101*m*, 101*c*, and 101*y* on which the electrostatic latent image is formed, and the developing solutions can be sequentially and directly transferred at operations 300 to 304.

At operation 305, it can be determined whether the front end of the recording medium reaches the drive roller 123 during the transfer process. If the front end of the recording medium reaches the drive roller 123, the image forming apparatus can determine the recording medium type at operation 306, such that it can be determined whether the recording medium type is a low-resistance recording medium having low resistance of R1 at operation 307. If the low-resistance recording medium is decided, a positive (+) power source having the same polarity as that of the transfer power source can be applied to the drive roller 123 at operation 308, wherein the positive (+) power source is denoted by 'V1' less than a predetermined normal power source (Vref). The reason why the V1 power source is applied to the drive roller 123 is that the attractive force in connection with the image transfer belt (ITB) 113 can be relatively lower than that of the normal-resistance recording medium (Rref) so that this recording medium may be easily detached from the image transfer belt (ITB) 113.

In the meantime, if the recording medium is not determined to be the low-resistance recording medium, the image forming apparatus can determine whether the recording medium is the high-resistance recording medium at operation 309. In the case of the high-resistance recording medium, the positive (+) power source having the same polarity as that of the transfer power source can be applied to the drive roller 123 at operation 310, wherein the positive (+) power source can be denoted by 'V2' higher than the predetermined normal power source (Vref). The reason why the V2 power source is applied to the drive roller 123 is that the attractive force in connection with the image transfer belt (ITB) 113 can be relatively stronger than that of the normal-resistance recording medium (Rref) so that it is difficult to detach this recording medium from the image transfer belt (ITB) 113. In this case, if the high-resistance recording medium is not decided at operation 309, the image forming apparatus can recognize the recording medium having resistance (Rref) as a normal-resistance recording medium, and can provide the drive roller 123 with the positive (+) power source having the same polarity as that of the transfer power source, wherein this positive (+) power source is set to the predetermined normal power source (Vref) at operation 311.

Also, it can be determined whether the transfer process has been completed at operation 312. If the transfer process is completed at the photo-conductor 101*y* and the transfer device 118*y* of the last image forming unit, the recording medium type can be decided at operation 313, such that it can be determined whether this recording medium is a low-resistance recording medium at operation 314. If the low-resistance recording medium is decided, a negative (−) power source having the opposite polarity to the transfer power source can be applied to the drive roller 123, and this negative (−) power source can be denoted by 'V2' higher than the predetermined normal power source (Vref) at operation 315. The reason why the V2 power source is applied to the drive roller 123 is that the low-resistance recording medium needs a relatively high attractive force to prevent the recording medium from being detached from the image transfer belt (ITB) 113.

In the meantime, if the recording medium is not determined to be the low-resistance recording medium at operation 314, the image forming apparatus can determine whether the recording medium is the high-resistance recording medium at operation 316. In the case of the high-resistance recording medium, the negative (−) power source having an opposite polarity to the transfer power source can be applied to the drive roller 123 at operation 317, wherein the negative (−) power source can be denoted by 'V1' less than the predetermined normal power source (Vref). The reason why the V1 power source is applied to the drive roller 123 is that the high-resistance recording medium can be brought into contact with the image transfer belt (ITB) 113 with a relative low attractive force.

In the meantime, if the high-resistance recording medium is not decided at operation 316, the image forming apparatus can recognize the recording medium having resistance (Rref) as a normal-resistance recording medium, and can provide the drive roller 123 with the negative (−) power source having the opposite polarity of the transfer power source, wherein this negative (−) power source can be considered to be the predetermined normal power source (Vref) at operation 311. Thereafter, the image forming apparatus can follow a predetermined routine.

As is apparent from the above description, in the direct transfer type image forming apparatus to form an image by attaching a recording medium on the ITB and carrying the recording medium, a power source having the same polarity as that of a transfer power source can be applied to the drive roller at a time at which an upper end of the recording medium is detached from the ITB, such that repulsive force against the recording medium occurs, and the detachment of the recording medium can be more easily carried out. Another power source having the opposite polarity of the transfer power source can be applied to the drive roller at another time at which the adhesive force between the back end of the recording medium and the ITB becomes weaker, such that attractive force drawing the recording medium to the ITB occurs and thus the recording medium can be brought into contact with the ITB with higher force.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

an image transfer belt (ITB) to carry a recording medium on which an image is transferred by a transfer device;

a roller unit to support and rotate the image transfer belt (ITB);

a power-source unit to provide the roller unit with a power source; and a controller to control the power-source unit to provide the power source with a same polarity as a transfer power source of the transfer device between when a front end of the recording medium passes the roller unit and when an image formed on the recoding medium reaches the roller unit, and to subsequently control the power-source unit to stop providing the power source to the roller unit before the image formed on the recording medium reaches the roller unit.

2. The image forming apparatus of claim 1, wherein the controller controls the power-source unit to provide the power source with a polarity opposite to that of the transfer power source of the transfer device, after the transfer device finishes a transfer process.

3. The image forming apparatus of claim 2, wherein the controller controls the power-source unit to stop providing the power source to the roller unit after a back end of the recording medium passes the roller unit.

4. The image forming apparatus of claim 1, wherein a plurality of transfer devices are arranged in a direction of carrying the recording medium, and the polarity of the power source provided to the roller unit is decided on the basis of the polarity of the transfer power source of a first transfer device disposed adjacent to the roller unit.

5. The image forming apparatus of claim 4, wherein a press device is located in front of a second transfer device, arranged first among the plurality of transfer devices in the direction of carrying the recording medium, and the transfer power sources of the first and second devices have the same polarity.

6. A method of controlling an image forming apparatus which includes an image transfer belt (ITB) to carry a recording medium on which an image is transferred by a transfer device, and a roller unit to support and rotate the image transfer belt (ITB), the method comprising:

determining whether the recording medium reaches the roller unit; and providing the roller unit with a power source with the same polarity as that of a transfer power source of the transfer device between when a front end of the recording medium passes the roller unit and when an image formed on the recording medium reaches the roller unit; and powering off the power source provided to the roller unit before the image formed on the recording medium reaches the roller unit.

7. The method of claim 6, further comprising:

deciding whether a transfer process is completed after providing the power source with the same polarity as that of the transfer power source; and providing the roller unit with the power source with a polarity opposite to that of the transfer power source after finishing the transfer process.

8. The method of claim 7, further comprising:

powering off the power source provided to the roller unit after a back end of the recording medium passes the roller unit.

* * * * *